US005287566A

United States Patent [19]

Azada

[11] Patent Number: 5,287,566

[45] Date of Patent: Feb. 22, 1994

[54] SANITARY BIDET CONVERSION KIT FOR CONVENTIONAL TOILET BOWLS

[76] Inventor: Teodoro C. Azada, 922 Abington Rd., Cherry Hill, N.J. 08034

[21] Appl. No.: 77,927

[22] Filed: Jun. 18, 1993

[51] Int. Cl.[5] ..... E03D 9/08

[52] U.S. Cl. ..... 4/420.4; 4/448; 239/104

[58] Field of Search ..... 4/420.1–420.5, 4/443–448; 239/104, 570, 571

[56] References Cited

U.S. PATENT DOCUMENTS 1,564,963 12/1925 Kirgan ..... 239/104
3,186,643 6/1965 George et al. ..... 239/571 X
3,256,531 6/1966 Arensberg ..... 4/448
3,425,066 2/1969 Berger ..... 4/448 X

FOREIGN PATENT DOCUMENTS 0209265 4/1909 Fed. Rep. of Germany ..... 4/447

*Primary Examiner*—Robert M. Fetsuga

[57] ABSTRACT

A sanitary bidet conversion kit for conventional water closet flush toilets is disclosed. The kit includes a T-shaped pipe to be connected the toilet tank water supply, a nozzle mounted in an upward direction within the toilet bowl and a hose including a flow control valve connected between the T-shaped pipe and nozzle. The nozzle includes a cover pivotally mounted thereto which moves under the influence of gravity to cover the nozzle outlet when water flow through the nozzle is stopped.

3 Claims, 5 Drawing Sheets

Figure 1:
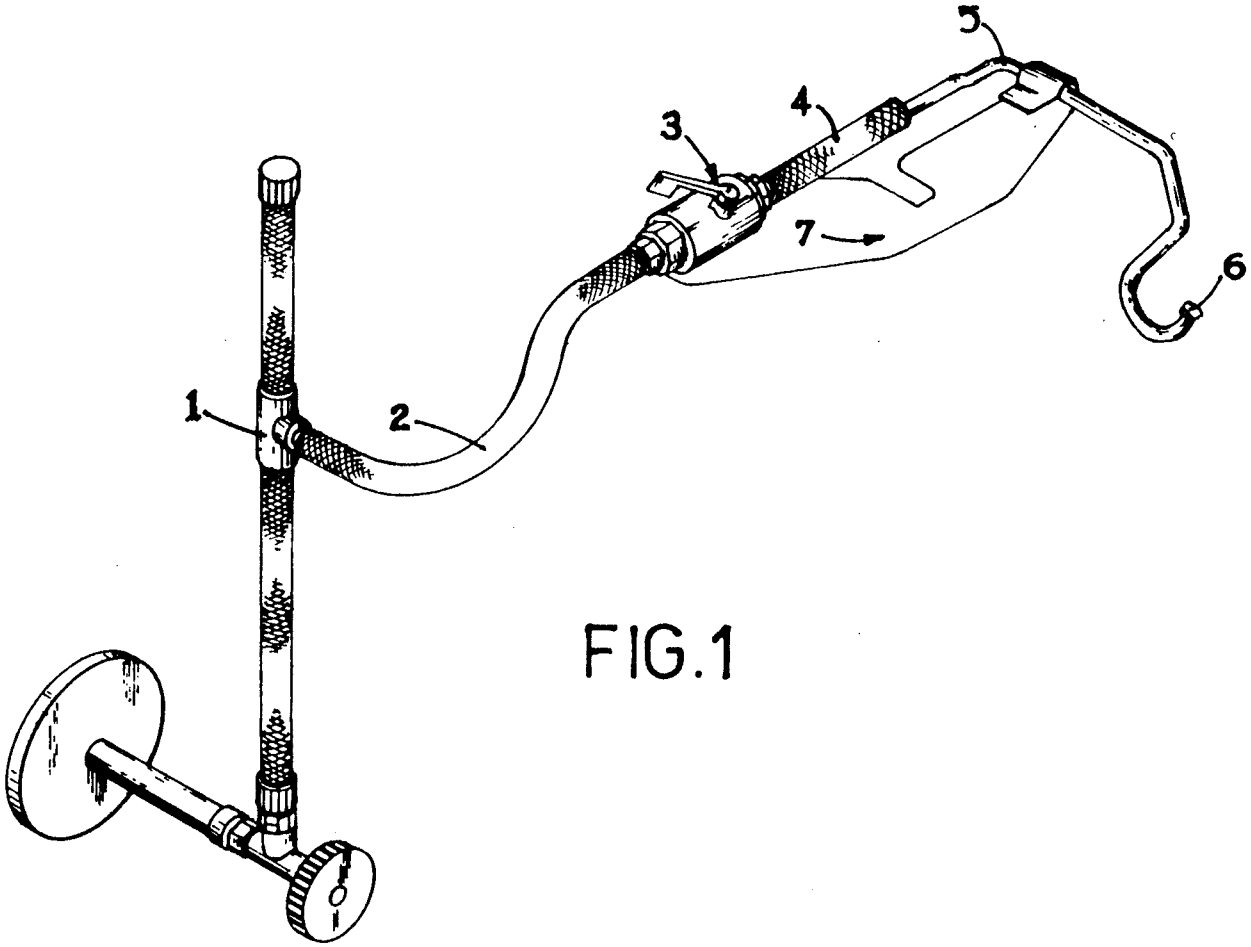
Figure 2:
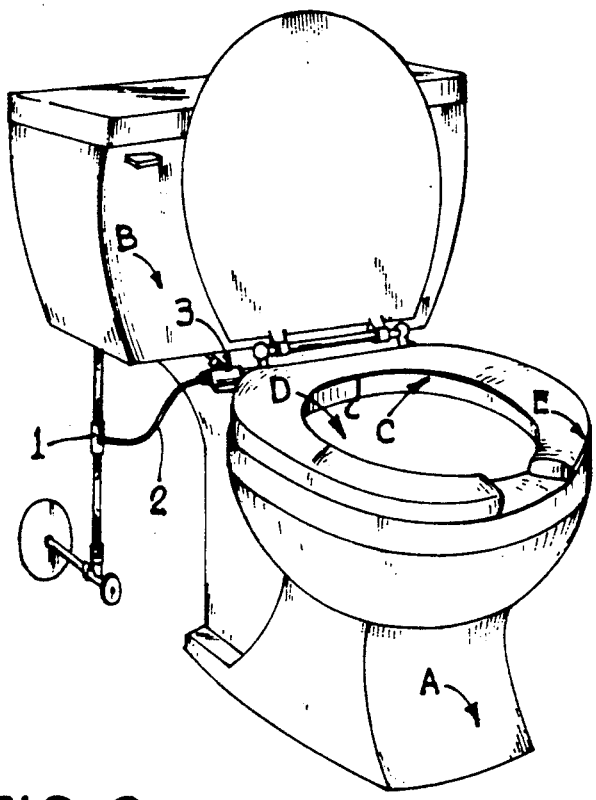
Figure 3:
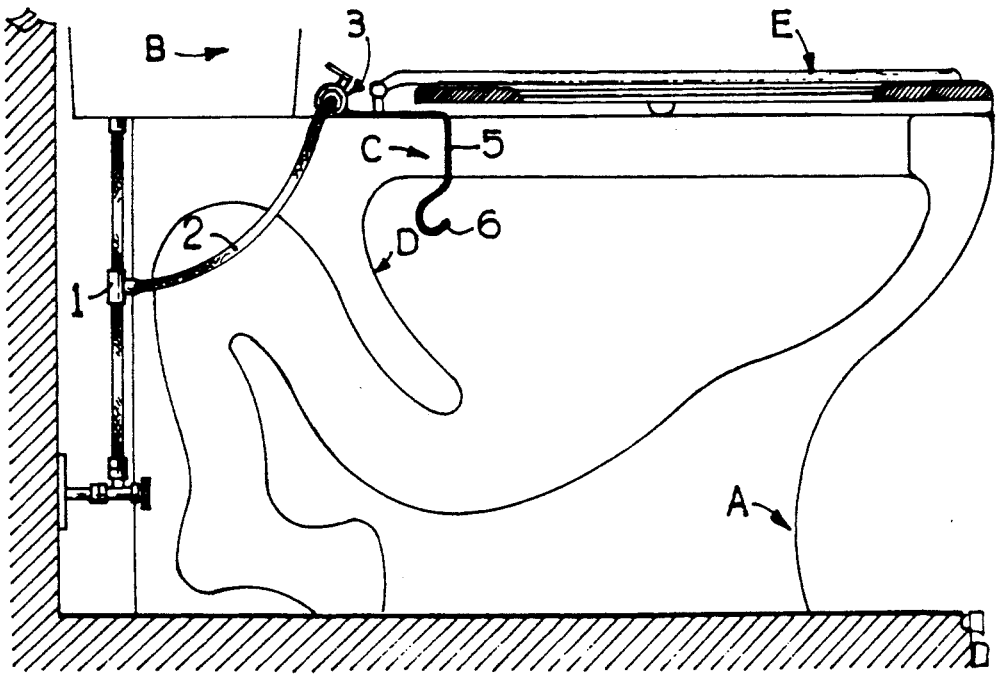
Figure 4:
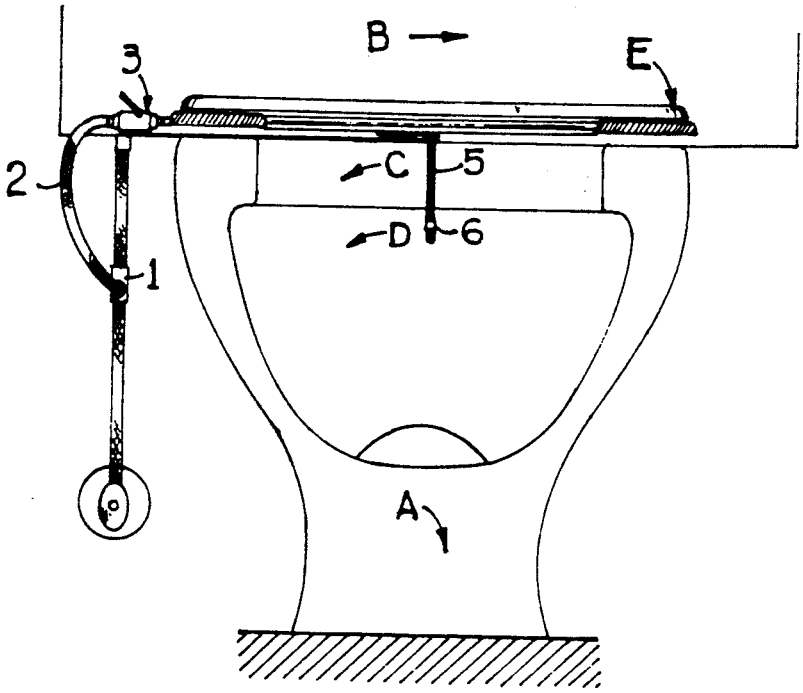

FIG.5
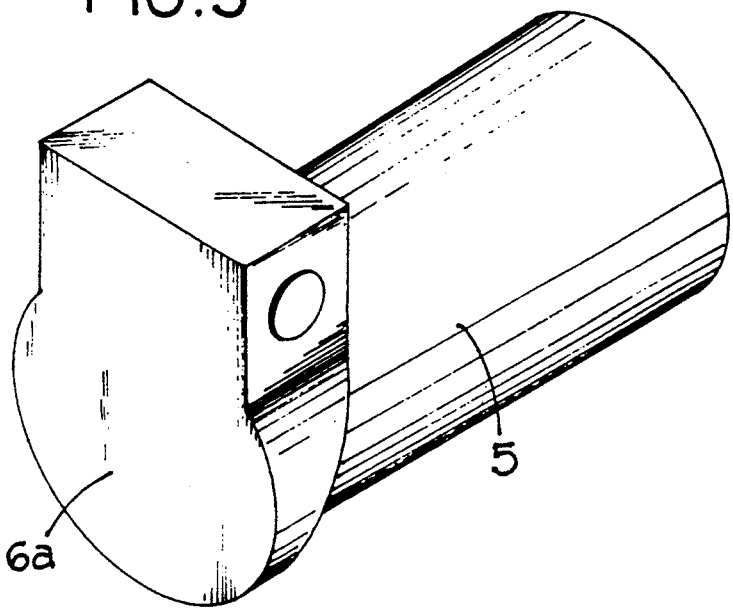
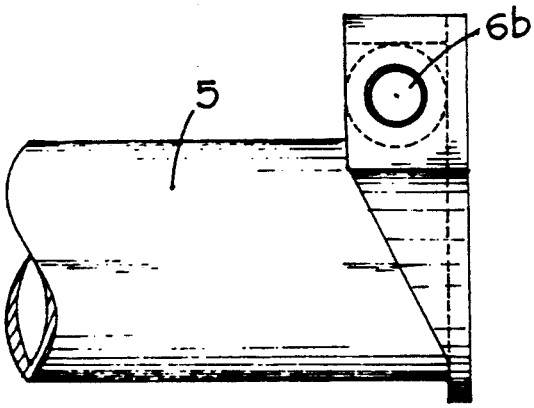
FIG.6
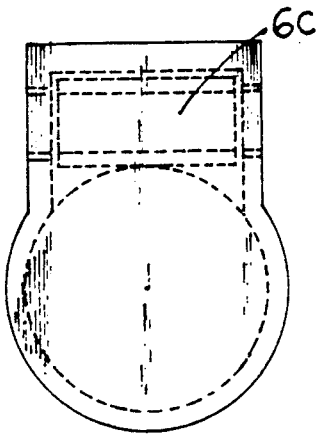
FIG.7

SANITARY BIDET CONVERSION KIT FOR CONVENTIONAL TOILET BOWLS

BACKGROUND OF THE INVENTION

A bidet provides a source of water from beneath a seated user. The use of bidets came out of a desire to find a way of cleaning the posterior part of the human body. As it is commonly known, bidet is a separate unit from the toilet. Such unit takes up additional floor space of the bathroom area. Furthermore, it is an additional cost to bathroom expense. These are some of the reasons why several devices were invented to eliminate the bidet bowl. Some devices are very complicated and expensive and require many movements to be able to use. They have to be swayed to the center of the bowl to use and swayed back to the side after use. Some are complicated to install, unsightly and interfere in the cleaning of the bowl. Other devices get contaminated by body waste which defeat the major purpose of its installation.

The object of the present invention is to provide the simplest device to install and use and most importantly the most hygienic form of cleansing the posterior part of the human body. This invention relates to the improvements to all prior attempts to supply the need of a device to cleanse the anal and vaginal areas of personal sanitarily and conveniently.

SUMMARY OF THE INVENTION

This invention relates to a sanitary device that is attached to a conventional toilet bowl to provide the user the facility of a bidet. This invention solves the problem of putting up another bowl to be used as a bidet. This fixture is necessary not only for cleansing the rectal and genital areas of the human body but also for medical reasons. This can do enema without the usual instrument. This also helps those with hemorrhoidal problems and a great convenience to women during their menstrual period and post-childbirth and also for post-surgery patients.

There were several inventions similar to this but there is one distinctive feature that will prove to be vital to a bidet with the same set up as this one. This invention has the hygienic device that prevents dirt from coming into the passageway of the water by means of a protective cover at the nozzle of the pipe which opens when in use and automatically closes after use. Another feature of this invention is that the dirt being washed from the body does not drop into the source of the water like the conventional bidets. The water from this invention flows from the back part of the toilet bowl towards the front and in the process the dirt is carried away from the water source. Aside from the sanitary features of this invention, the operation is very simple. Just turn the faucet on to use and off after use. The extra movements of extending and retracting or swaying and returning of the nozzle is eliminated.

For further information and specific detail of the function and advantages of the invention, refer to the brief description of the illustrations attached herewith.

DESCRIPTION OF THE ILLUSTRATIONS

FIG. 1:

There are seven parts which make up one complete device, The first is a tee (1) connected to the water source; the second is the conduit hose (2) between the water source and the valve; the third is the valve (3) which controls the flow of water; the fourth is another conduit hose (4) at the other end of the valve; the fifth is the pipe (5) from the conduit extending to the lower back part of the toilet bowl; the sixth is the covered nozzle (6); and the seventh is the plate (7) which is bolted to the back part of the rim of the toilet bowl to keep the valve in place.

FIG. 2:

The isometric view of the toilet showing the kit as positioned on the toilet bowl of the conventional water closet.

FIG. 3:

This is the side view illustration. All conventional toilets are installed with a cut-off valve and a conduit pipe or hose to supply water to the tank. A tee pipe (1) is attached to the conduit hose supplying water to the toilet water tank to deviate water to another conduit hose (2) which is connected to the valve (3). The valve (3) controls the flow of water that comes out of the covered nozzle (6). Valve (3) is ideally located between the seat and the water tank (B). The connecting conduit pipe (5) is hidden beneath the toilet seat and goes downward along the rim (C) of the toilet bowl (A) and then backward towards the wall (D) then downward and bent forward at an angle to direct the flow of water coming out of the covered nozzle (6) toward the area at the center of the toilet seat (E). The cover of the nozzle (6) opens when water goes out and closes when water is cut-off.

FIG. 4:

The front view of FIG. 1 showing the flow of the conduit pipe (5) on top of the toilet rim (C) and the turn toward the front halfway of the back of the toilet bowl (A) then downward along the rim (C) and toward the wall (D) of the bowl.

FIG. 5:

The isometric view of the nozzle showing the top and the side of the cover (6*a*) at the end of the conduit pipe (5).

FIG. 6:

The side view of the nozzle showing the wrap of the cover at the outside of the conduit pipe (5) opening. Also shown is the pin (6*b*) of the hinge at the upper portion of the pipe connected to the cover which opens when water goes out and closes when water is shut off.

FIG. 7:

The front view of the nozzle cover, the salient feature of this bidet kit. The hinge (6*c*) is shown in phantom line on the top part of the cover.

While the above provides a full and complete disclosure of the preferred embodiments of the invention, various modifications, alternate constructions, and equivalence may be employed without departing from the true spirit and scope of the invention.

I claim:

1. A sanitary bidet conversion kit for toilets having a toilet bowl, a toilet tank and a pressurized water supply for the tank, said sanitary bidet conversion kit comprising:

means for deviating water from said water supply;

a hose fluidly connected to said water deviating means to receive water flow therefrom;

means for selectively controlling said flow of water through said hose between flow and non-flow conditions;

a bidet nozzle fluidly connected to said flow controlling means, said nozzle having a cover pivotally connected thereto and freely movable between a first position covering the outlet of said nozzle and a second position spaced from said outlet to allow water flow therefrom; and means for mounting said nozzle within said toilet bowl such that said nozzle is directed upwardly causing said cover to assume said first position under the influence of gravity;

whereby when said flow condition of said flow controlling means is selected, waster flow through said nozzle causes said cover to be pivoted upwardly to allow water to flow from said nozzle.

2. The sanitary bidet conversion kit in accordance with claim 1, wherein said deviating means comprises a T-shaped pipe.

3. The sanitary bidet conversion kit in accordance with claim 1, wherein said flow controlling means comprises a valve disposed in said hose.

* * * * *